US006325222B1

(12) United States Patent
Avery et al.

(10) Patent No.: US 6,325,222 B1
(45) **Date of Patent: *Dec. 4, 2001**

(54) ADJUSTABLE HEALTH IMPROVEMENT DEVICE FOR MODIFYING A DAILY BEHAVIOR BY REMINDING A PERSON TO TAKE MEDICATION

(75) Inventors: Allan R. Avery, New Canaan; Lawrence H. Bernstein, Storrs, both of CT (US)

(73) Assignee: Rxtra, Inc., Norwalk, CT (US); a part interest ( * ) Notice: Subject to any disclaimer, the term of this patent is extended or adjusted under 35 U.S.C. 154(b) by 0 days.

This patent is subject to a terminal disclaimer.

(21) Appl. No.: 09/449,753

(22) Filed: Nov. 26, 1999

Related U.S. Application Data

(63) Continuation of application No. 08/977,047, filed on Nov. 25, 1997, now Pat. No. 6,053,338.

(51) Int. Cl.[7] ..... A45D 44/18

(52) U.S. Cl. ..... 211/65; 211/74; 211/184; D6/528

(58) Field of Search ..... 211/65, 74, 184, 211/43, 85.18, 175, 85; D6/527–528, 531, 534–535; 248/110, 310, 311.2, 313; 132/308–309; 206/362.1–362.3

(56) References Cited

U.S. PATENT DOCUMENTS

| | | | | |
|---|---|---|---|---|
| D. 154,689 | | 8/1949 | Lundgren . | |
| D. 246,489 | | 11/1977 | Cunningham . | |
| D. 344,763 | | 3/1994 | Vitantonio et al. . | |
| D. 389,686 | | 1/1998 | Drage . | |
| D. 405,996 | * | 2/1999 | Mickler et al. | D6/527 |
| D. 407,250 | * | 3/1999 | Avery et al. | D6/528 |
| D. 407,756 | | 4/1999 | Avery et al. . | |
| D. 417,469 | | 12/1999 | Avery et al. . | |
| 571,436 | | 11/1896 | Glentworth . | |
| 612,296 | | 10/1898 | Woodward . | |
| 675,364 | | 5/1901 | Burton . | |
| 1,261,585 | | 4/1918 | Mayo . | |
| 1,649,814 | | 11/1927 | Lellis . | |
| 1,710,642 | | 4/1929 | Hammet . | |
| 2,099,906 | | 11/1937 | Reese . | |
| 2,232,171 | | 2/1941 | Fleenor . | |
| 2,415,447 | | 2/1947 | Stanton . | |
| 2,417,874 | * | 3/1947 | Kehl | 211/65 |
| 2,432,764 | | 12/1947 | Jenkins . | |
| 2,444,488 | | 7/1948 | Aschemeier . | |
| 2,450,337 | | 9/1948 | Hearst . | |
| 2,570,380 | | 10/1951 | Rosier . | |
| 2,579,695 | | 12/1951 | Parsons . | |
| 2,608,294 | | 8/1952 | Ward . | |
| 2,956,851 | | 10/1960 | Merendino . | |
| 3,228,737 | | 1/1966 | Kipnis . | |
| 3,521,936 | | 7/1970 | Coker, Jr. . | |
| 3,524,690 | | 8/1970 | Gurney . | |

(List continued on next page.)

*Primary Examiner*—Daniel P. Stodola
*Assistant Examiner*—Jennifer E. Novosad
(74) *Attorney, Agent, or Firm*—Dinesh Agarwal, P.C.

(57) ABSTRACT

An adjustable health improvement device for modifying a daily behavior by reminding a person to take medication includes a generally vertical housing for removably holding an instrument, such as a toothbrush, for use in a daily activity. A second adjoining member is operably connected to the housing member and defines therebetween a recess for retaining a container for holding a material, such as medication, to be taken by the person. The second member is movable relative to the housing for adjusting the size of the recess to accommodate various sizes of, for example, medicine bottles. When a person reaches to use the toothbrush, for example, the person is reminded to take the medication due to its close proximity.

17 Claims, 4 Drawing Sheets

U.S. PATENT DOCUMENTS

| | | | |
|---|---|---|---|
| 3,762,673 | | 10/1973 | Koslovsky . |
| 3,880,281 | | 4/1975 | Taddei . |
| 3,884,635 | | 5/1975 | Sloan . |
| 3,921,649 | | 11/1975 | Milbrath . |
| 4,068,760 | | 1/1978 | Johnson, Jr. . |
| 4,115,508 | | 9/1978 | Sturtevant . |
| 4,140,140 | | 2/1979 | Proia et al. . |
| 4,219,035 | | 8/1980 | Deconinck . |
| 4,248,254 | | 2/1981 | Trimble . |
| 4,307,923 | | 12/1981 | Raz . |
| 4,466,150 | | 8/1984 | Jurt . |
| 4,681,219 | | 7/1987 | Kitchens . |
| 4,874,099 | | 10/1989 | Arnott et al. . |
| 4,951,596 | | 8/1990 | Wallace, Jr. . |
| 4,964,683 | | 10/1990 | Sugarek et al. . |
| 4,978,003 | | 12/1990 | Foster . |
| 5,033,709 | | 7/1991 | Yuen . |
| 5,072,477 | | 12/1991 | Pai . |
| 5,183,163 | | 2/1993 | Slaiken . |
| 5,215,193 | | 6/1993 | Dennis . |
| 5,271,353 | | 12/1993 | Besthorne . |
| 5,507,414 | * | 4/1996 | Ong ..... 211/65 |
| 5,522,497 | * | 6/1996 | Stacy ..... 206/362.1 |
| 5,560,578 | | 10/1996 | Schenken et al. . |
| 5,839,578 | | 11/1998 | Avery . |

* cited by examiner

ADJUSTABLE HEALTH IMPROVEMENT DEVICE FOR MODIFYING A DAILY BEHAVIOR BY REMINDING A PERSON TO TAKE MEDICATION

This is a continuation of Ser. No. 08/977,047, filed Nov. 25, 1997, now U.S. Pat. No. 6,053,338.

FIELD AND HISTORICAL BACKGROUND OF THE INVENTION

The present invention is directed to a health improvement device which modifies a daily behavior by reminding a person to take medication as directed by the doctor, and more particularly to a device which is adjustable so as to accommodate medicine containers of different sizes.

It has been observed by medical professionals and other behavioral scientists that remembering to take prescription or other medication, day after day, is a routine that is usually hard to establish. In this regard, it is known that taking medication at prescribed intervals or time is not only important, but in many instances, could be critical. The failure of a person to take the medication, as prescribed, may have adverse impact on the health of a person. It is therefore important that a simple and easy to use device be provided which reminds a person to take the medication.

Various examples of conventional devices of this nature and various medicine containers are disclosed in U.S. Pat. Nos. 571,436; 675,364; 612,296; 1,261,585; 1,710,642; 2,432,764; 2,444,488; 2,450,337; 2,570,380; 2,608,294; 3,228,737; 3,521,936; 3,524,690; 3,880,281; 3,884,635; 4,140,140; 4,116,508; 4,248,254; 4,307,923, 4,308,923; 4,466,150; 4,951,596; 4,964,683; 4,978,003; 5,072,477; 5,271,353; and Des. 246,489.

One example of a health improvement device which modifies a daily behavior by reminding a person to take medication is disclosed in U.S. Ser. No. 08/822,756, filed Mar. 24, 1997, which is incorporated herein in its entirety by reference. The device disclosed therein includes a vertically upstanding housing with a first section for holding a toothbrush and a second section which includes a recess for holding a medicine container. Since both first and second sections are integrally formed, the size of the recess is fixed and cannot be varied. Therefore, only one size medicine container can be used with this type of device. In other words, the disclosed device cannot be used with containers of varying sizes and it becomes necessary to manufacture and stock several devices with different size recess to accommodate different size containers.

Accordingly, there is a need for a health improvement device for modifying a daily behavior by reminding a person to take medication which is adjustable so as to accommodate containers of varying sizes.

OBJECTS AND SUMMARY OF THE INVENTION

The main object of the present invention is to provide a health improvement device which is adjustable for accommodating containers of varying sizes.

Another object of the present invention is to provide an adjustable health improvement device which eliminates the necessity of manufacturing and stocking different size health improvement devices for accommodating different size containers.

Yet another object of the present invention is to provide a simple to use and an inexpensive, adjustable health improvement device which modifies a person's daily behavior by reminding the person to take medication, as directed.

Still yet another of the present invention is to provide an adjustable health improvement device which overcomes the disadvantages associated with the conventional devices.

An additional object of the present invention is to provide an adjustable health improvement device which creates a simple association between the daily habit of toothbrushing and another habit a doctor wants each patient to develop, that is of taking medication properly.

Yet an additional object of the present invention is to provide an adjustable health improvement device which reminds the patient, when reaching for his or her toothbrush, to take medication at the same time.

Still an additional object of the present invention is to provide an adjustable health improvement device which allows the medication to work as it should, since it is being taken as prescribed by the doctor, for example, once daily in the morning, or both morning and at night.

Still yet an additional object of the present invention is to provide an adjustable health improvement device which results in better compliance and more effective therapy and therefore saves needless medical visits and extra costs for the patient and the insurance provider.

An additional object of the present invention is to provide an adjustable health improvement device which is versatile in that it can be reused with different medicine containers. In other words, once the medication supply is exhausted, the device can be reused with other medicine containers.

In summary, the main object of the present invention is to provide a health improvement device which is adjustable for accommodating different size containers, simple, inexpensive, versatile and modifies a person's daily behavior to serve as a reminder to take a prescription medication, as directed.

BRIEF DESCRIPTION OF THE DRAWINGS

The above and other objects and advantages and novel features of the present invention will become apparent from a review of the preferred embodiment of the invention, and as illustrated in the drawings, in which:

FIG. 3 is a top plan view of the health improvement device of FIG. 1, shown in the completely open position;

DETAILED DESCRIPTION OF THE PREFERRED EMBODIMENT OF THE INVENTION

Figure 1:
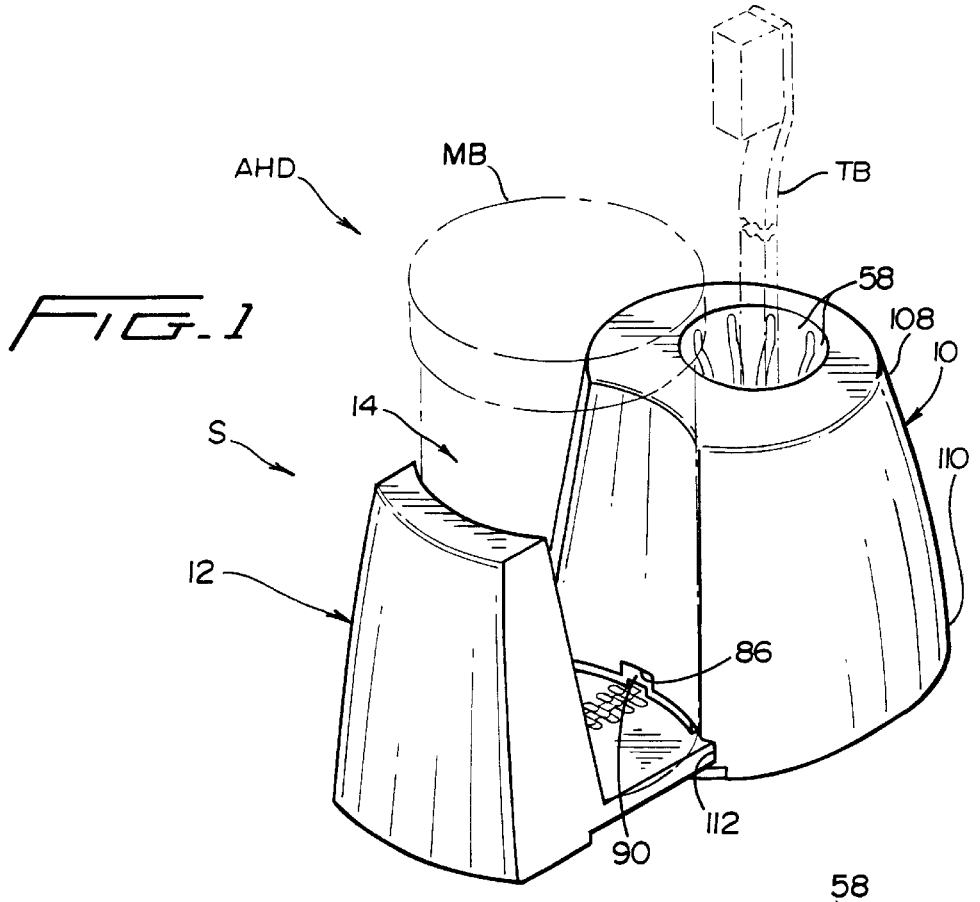
FIG. 1 is a left perspective view of the health improvement device of the present invention, shown with a toothbrush and a medicine bottle in phantom lines.
Figure 2:
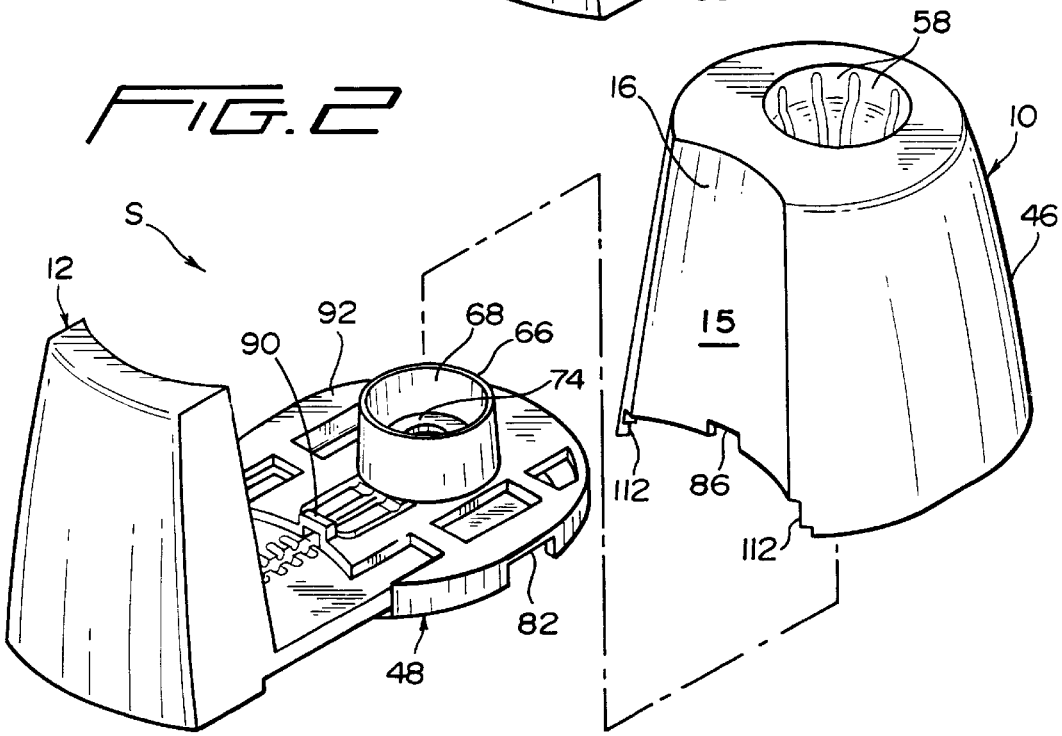
FIG. 2 is partially exploded perspective view of the health improvement device shown in FIG. 1.

As best shown in FIGS. 1–2, the health improvement device AHD of the present invention is in the form of a generally vertically upstanding support structure S, which is preferably made of conventional materials, such as polyvinyl chloride (PVC), polypropylene, any high density polyethylene or the like, thermoplastic, or other suitable material, which may be easily molded, blown or otherwise shaped to obtain the desired configuration.

The support structure S includes a generally cylindrical, inverted cup-shaped hollow housing section 10 and a holder section 12. As can be best seen from FIGS. 1–5, the heights of the housing section 10 and holder section 12 are substantially the same. It is, however, noted that the corresponding heights of these two sections may be varied, if necessary.

Figure 4:
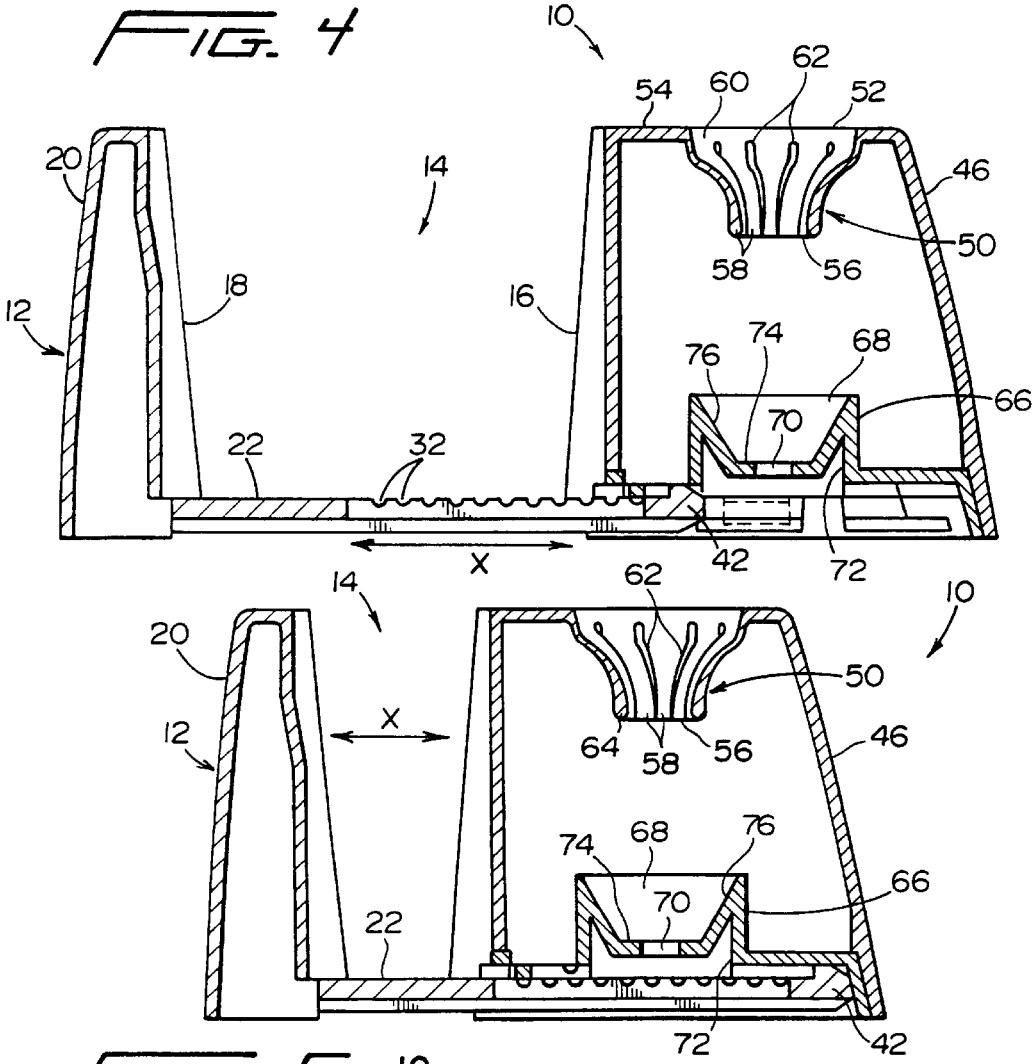
FIG. 4 is a vertical cross-sectional view taken along line 4—4 of FIG. 3.
Figure 5:
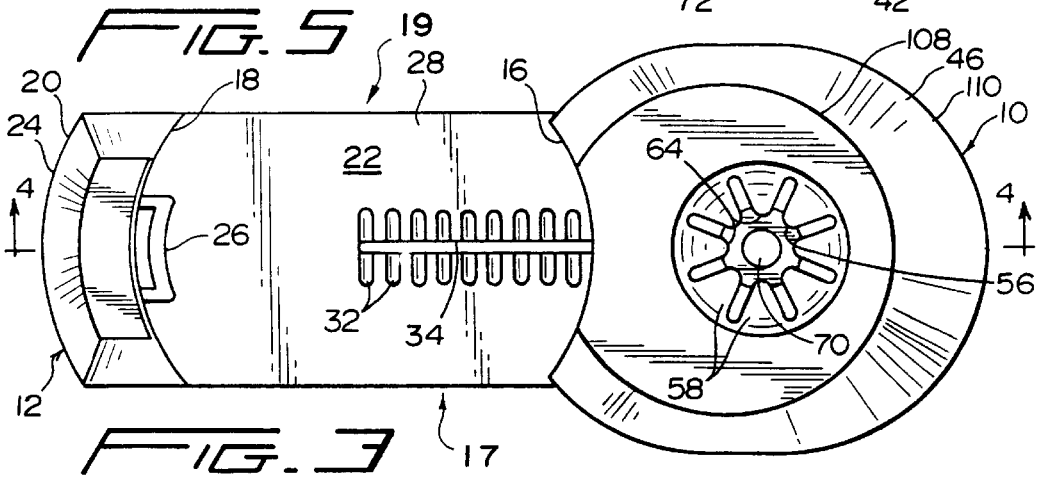
FIG. 5 is a view similar to FIG. 4, showing the health improvement device in the completely closed position.

As can be seen from FIG. 1, the housing section 10 is provided for receiving an instrument, such as a toothbrush TB, and holding it securely and generally vertically therein. As best shown in FIGS. 1 and 3–5, housing section 10 and holder section 12 define therebetween a recess 14 for holding a medicine bottle MB. As illustrated in FIGS. 4–5 by arrow X, holder section 12 is slidable relative to housing section 10 to thereby vary the gap therebetween so as to adjust the size of recess 14 for accommodating different size medicine bottles.

In order to securely hold medicine bottle MB in the recess 14, housing section 10 includes vertically extending uninterrupted partition wall 15 with an inwardly arcuate surface (FIG. 2) 16, and holder section 12 includes an inwardly arcuate surface 18 disposed opposite to surface 16 (see FIG. 3). Preferably, the radii of curvature of surfaces 16 and 18 generally correspond to the radius of curvature of medicine bottle MB so that the medicine bottle can be held securely in the recess 14 defined by surfaces 16 and 18. In this regard, one would observe that since recess 14 is only bound by opposed vertical surfaces 16 and 18 and at the bottom, leaving the top and front and rear open, by sliding holder section 12 relative to housing section 10, medicine bottles of varying diameters can be easily accommodated in recess 14. It is noted herewith that the surfaces 16 and 18 may be made planar or have other configuration so as to accommodate containers of different shapes, dimensions, etc. The holder section 12 includes front 17 and rear 19 (FIG. 3). The partition wall 15 extends substantially from front 17 to the rear 19 of section 12.

Figure 6:
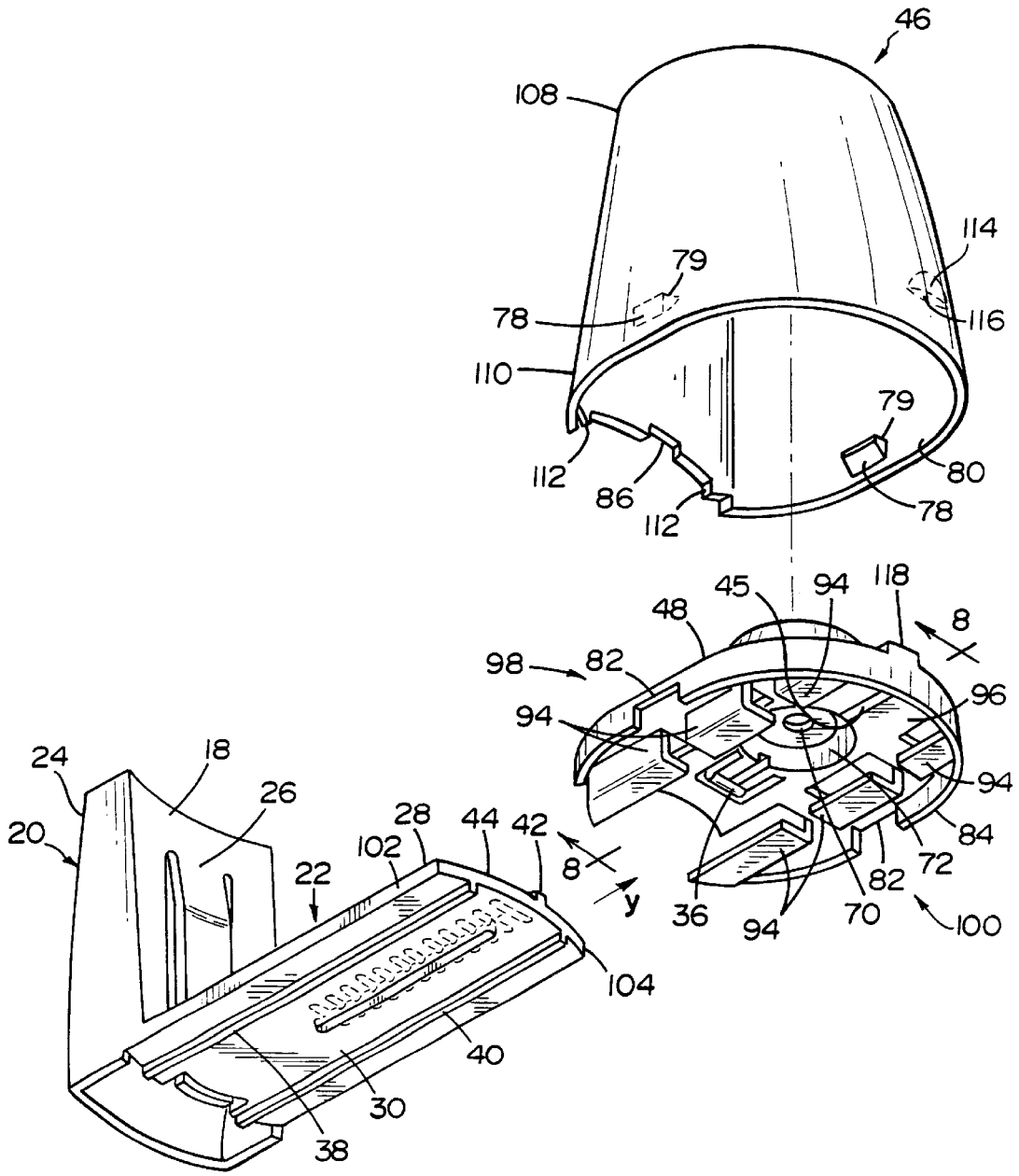
FIG. 6 is an exploded bottom perspective view of the health improvement device shown in FIG. 1.

As best shown in FIGS. 3–6, the holder section 12 includes a generally vertical clip section 20 and a generally planar slider 22 extending horizontally therefrom. The clip section 20, as best shown in top plan view in FIG. 3, is generally C-shaped with inner arcuate surface 18 and outer arcuate surface 24. As best shown in FIG. 6, a cantilevered tongue member 26 is provided on surface 18, which functions as a spring for biasing medicine bottle MB. Preferably, spring member 26 extends downwardly upto about slider 22.

The slider 22 is preferably integrally formed with clip 20 and is in the form of a generally planar elongated member with top and bottom surfaces 28 and 30, respectively. As best shown in FIGS. 3–5, top surface 28 includes a plurality of cavities or notches 32. The cavities 32 are preferably oblong in shape and are successively disposed in a parallel relationship to each other. As can be observed from FIGS. 5–6, the cavities 32 do not extend through the thickness of slider 22 and are oriented generally transverse thereto. A slot 34 extends through the thickness of slider 22 and runs transversely through cavities 32. The depth and dimensions of cavities 32 are designed as to selectively receive a locking male member 36 provided in cup section 10 (see FIG. 6).

As best illustrated in FIG. 6, two guide ribs 38 and 40 are provided on the bottom surface 30 of slider 22. The ribs 38 and 40 preferably run the length of slider 22 and extend generally parallel to each other for guiding the slider 22 in and out of housing section 10.

An upwardly extending hook 42 is provided at the free end 44 of slider 22 and ravels in channel 45 provided in housing section 10. The hook 42 engages locking ember 36 when holder section 12 is completely pulled away from housing section 10 and functions to prevent the housing and holder sections from being separated.

As best shown in FIGS. 2 and 6, housing section 10 includes an upper dome-shaped cover 46 releasably fitted over base 48. As best shown in FIGS. 4–5, cover 46 preferably includes an integrally formed toothbrush guide 50 which extends vertically and radially inwardly into the cover 46. The guide 50 terminates at top opening 52, which is generally coterminous with top surface 54 of cover 46, and bottom opening 56. The diameter of top opening 52 is significantly larger than the diameter of bottom opening 56 so as to facilitate insertion of toothbrush TB into section 10.

As best shown in FIGS. 1–2 and 3–5, guide 50 is comprised of a plurality of radially inwardly extending finger-like projections 58 which extend inwardly and downwardly from top surface 54 into the cover 46. As can be seen from FIGS. 4–5, although projections 58 are joined together adjacent their top ends 60, they are separated from one another by slits 62 and terminate as free ends 64 inside cover 46, and together define bottom opening 56. As a result of this configuration, the projections 58 are flexible and facilitate insertion and removal of toothbrush TB from the cover 46.

Figure 8:
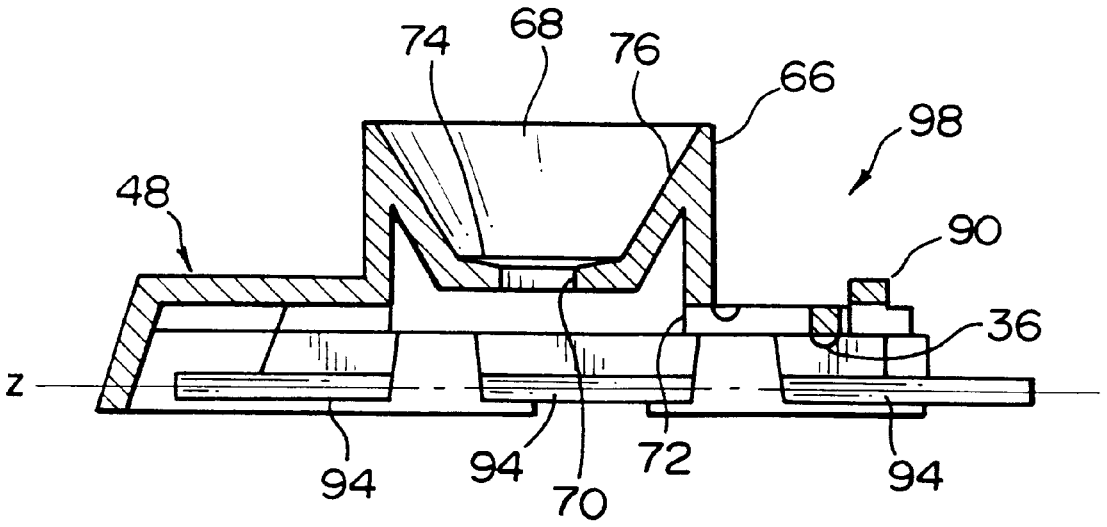
FIG. 8 is an enlarged vertical cross-sectional view taken along line 8—8 of FIG. 6.

As best shown in FIGS. 2, 4–5 and 8, a yoke member 66 is provided centrally on base 48 and is in general vertical alignment with guide 50. The yoke member 66 includes a generally funnel-shaped recess 68 with a bottom drain hole 70. As best shown in FIGS. 6 and 8, hole 70 communicates with opening 72 which is in communication with the exterior. The recess 68 terminates at bottom 74 the diameter of which is designed so as to accommodate the bottom of toothbrush handle.

As best shown in FIGS. 4–5, the top and bottom openings 52 and 56 of guide 50, and recess 68 of yoke 66 are in general vertical alignment so that when toothbrush TB is placed in cover 46, it is secured vertically therein. Moreover, when toothbrush TB is placed in housing section 10, after brushing teeth, for example, any liquid or moisture present thereon drips downwardly in yoke 66, and due to its generally conical inner wall 76, gets collected at bottom 74 and flows outwardly through drain hole 70 to the exterior through bottom opening 72.

As best shown in FIG. 6, a pair of generally triangular in cross-section tabs 78 are oppositely positioned on the inside wall 80 of cover 46. The tabs 78 are wedged in corresponding cut-outs 82 in the skirt portion 84 of base 48 at surfaces 79, for thereby retaining cover 46 thereon. In order to keep cover 46 properly aligned over base 48, an alignment notch 86 is provided at the bottom edge 88 of arcuate surface 16. The notch 86 receives an alignment projection 90 extending from the upper surface 92 of base 48 (see FIGS. 2 and 8).

Figure 7:
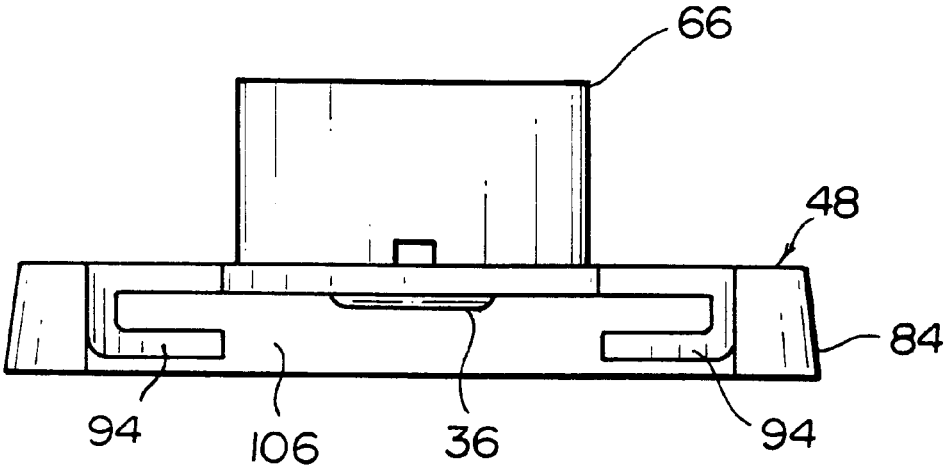
FIG. 7 is an enlarged elevational view of the housing section base seen in the direction of arrow Y in FIG. 6.

As best illustrated in FIG. 6, six generally L-shaped guide brackets 94 suspend downwardly from the lower surface 96 of base 48. Three brackets 94 are arranged linearly in succession on one side with the remaining three being opposite thereto (see FIGS. 8). In other words, three brackets are arranged along a line Z on front side 98 of base 48, and the remaining three are arranged along a line on rear side 100 thereof. The three brackets 94 on the front side 98 guide front side edge 102 of the slider 22, and the other three brackets 94 lying on the rear side 100 guide the rear side edge 104 thereof All six brackets 94 together, therefore, define a channel 106 for receiving the slider 22 (see FIG. 7).

As best shown in FIGS. 1–3 and 6, cover 46 is tapered upwardly such that the diameter of upper portion 108 is less than the diameter of lower portion 110. In FIGS. 1–2 and 6, reference numeral 112 designates lateral step portions 112 for accommodating the thickness of slider 22, and reference numeral 114 designates a tab provided on the inside wall 80 for guiding cover 46 over base 48. In particular, tab 114 includes a bottom ledge 116 which comes to rest on an upwardly extending projection 118 on base 48.

As can be easily seen from the above detailed description of a preferred embodiment of the invention, by sliding holder section 12 in and out of housing section 10, the size of recess 14 can be adjusted to accommodate various size medicine bottles. The adjustable health improvement device AHD of the present invention is therefore unique and very useful in that a person in reaching for a toothbrush, is easily reminded of taking the medication concurrently, since the medicine bottle is located in close proximity to the toothbrush.

While this invention has been described as having a preferred design, it is understood that it is capable of further modifications, uses and/or adaptations following in general the principle of the invention, and including such departures from the present disclosure as those come within the known or customary practice in the art to which the invention pertains, and as may be applied to the central features hereinsetforth, and fall within the scope of the invention and the limits of the appended claims.

What is claimed is:

1. An adjustable health improvement device for modifying a daily behavior by reminding a person to take medication, comprising:

a) a first housing member for removably holding an instrument for use in a daily activity;

b) a second member operably connected to said first member and defining therebetween a recess for retaining means for holding a material to be taken by a person;

c) said second member being movable relative to said first member for adjusting the size of said recess;

d) the size of said recess being adjustable to accommodate various sizes of said material holding means;

e) said second member including a front and rear;

f) said first and second members being separated by an uninterrupted vertically extending partition wall;

g) said partition wall extending substantially from the front to the rear of said second member;

h) said first housing member including top and bottom sections;

i) said first housing member including a yoke member for generally vertically holding said instrument therein; and j) said yoke member being positioned in said bottom section.

2. The health improvement device of claim 1, wherein:

said top section includes an opening; and a plurality of projections extend radially into said opening.

3. The health improvement device of claim 2, wherein:

said opening is vertically aligned with said yoke member.

4. The health improvement device of claim 2, wherein:

said plurality of projections are flexible.

5. The health improvement device of claim 1, wherein:

said yoke member includes a generally funnel-shaped recess with a drain opening.

6. The health improvement device of claim 1, wherein:

said second member includes an opening substantially across the front thereof for allowing continuous visual inspection of the material in said second member.

7. The health improvement device of claim 1, further comprising:

means for releasably interlocking said first and second members together.

8. The health improvement device of claim 7, wherein:

said second member includes a clip section for engaging a portion of said material holding means and a slidable member for operably connecting to said first member.

9. The health improvement device of claim 8, wherein:

said interlocking means comprises a male member and a female member.

10. The health improvement device of claim 9, wherein:

a) said male member comprises a projection provided on said first member; and b) said female member comprises a plurality of rectilinearly disposed cavities on said slidable member.

11. The health improvement device of claim 10, wherein:

said cavities are generally oblong in shape and extend transversely to a longitudinal axis of said slidable member.

12. The health improvement device of claim 1, wherein:

said second member is curved and includes inner and outer surfaces.

13. The health improvement device of claim 12, further comprising:

resilient means disposed relative to one of said inner and outer surfaces for tightly retaining said material holding means.

14. The health improvement device of claim 13, wherein:

said resilient means comprises a vertical member mounted at one end thereof on said inner surface of said second member.

15. The health improvement device of claim 13; wherein:

said resilient means comprises a vertical member cantilevered on said inner surface of said second member.

16. The health improvement device of claim 13, wherein:

said first housing member includes a vertically extending generally arcuate surface; and b) said arcuate surface is disposed generally opposite to said inner surface of said second member.

17. The health improvement device of claim 16, wherein:

said partition wall includes said arcuate surface.

* * * * *